US012509272B2

(12) United States Patent
Goess et al.

(10) Patent No.: US 12,509,272 B2
(45) Date of Patent: Dec. 30, 2025

(54) TRAY PACKAGE UNIT OUTER PACKAGING PAPER AND METHOD FOR PRODUCING SAME

(71) Applicant: Mondi AG, Vienna (AT)

(72) Inventors: Paulus Goess, Klagenfurt (AT); Elisabeth Schwaiger, St. Stefan (AT)

(73) Assignee: Mondi AG, Vienna (AT)

( * ) Notice: Subject to any disclaimer, the term of this patent is extended or adjusted under 35 U.S.C. 154(b) by 370 days.

(21) Appl. No.: 18/259,823

(22) PCT Filed: Dec. 28, 2021

(86) PCT No.: PCT/AT2021/060495

§ 371 (c)(1),
(2) Date: Jan. 17, 2024

(87) PCT Pub. No.: WO2022/140813

PCT Pub. Date: Jul. 7, 2022

(65) Prior Publication Data

US 2025/0340324 A1 Nov. 6, 2025

(30) Foreign Application Priority Data

Dec. 29, 2020 (AT) ..... A 51157/2020

(51) Int. Cl.
*B65D 77/00* (2006.01)
*B65D 5/20* (2006.01)
*D21J 3/10* (2006.01)

(52) U.S. Cl.
CPC ..... *B65D 5/20* (2013.01); *B65D 77/003* (2013.01); *D21J 3/10* (2013.01)

(58) Field of Classification Search
CPC ..... B65D 5/20; B65D 77/003; D21J 3/10
(Continued)

(56) References Cited

U.S. PATENT DOCUMENTS 2,158,755 A * 5/1939 Hodgdon ..... B32B 29/06 493/332
4,878,765 A * 11/1989 Watkins ..... B32B 27/10 428/34.3

(Continued)

FOREIGN PATENT DOCUMENTS

CN 109594422 4/2019
WO 2018/229336 12/2018

OTHER PUBLICATIONS

International Search Report.

*Primary Examiner* — Jacob K Ackun
(74) *Attorney, Agent, or Firm* — Dunlap, Bennett & Ludwig

(57) ABSTRACT

A tray package unit outer packaging paper (1), for packaging tray packing units (2), to a method for packaging tray packing units (2) using such a tray package unit outer packaging paper (1), to a method for producing same, and to use of an outer packaging material for packing a tray packaging unit (2). The tray package unit outer packaging paper (1) has a first face (3) and a second face (4) and is made of at least one aqueous suspension (5) comprising a cellulose material (6) and optionally additives (7). The first face (3) is compressed with a linear load of 80 kN/m to 500 kN/m. Additionally, the tray package unit outer packaging paper (1) has a wet tensile strength index, measured according to ISO 3781:2011, in the machine direction of at least 10 Nm/g auf.

16 Claims, 7 Drawing Sheets

(58) Field of Classification Search
USPC ..... 206/557, 524.1, 524.6
See application file for complete search history.

(56) References Cited

U.S. PATENT DOCUMENTS

| | | | | |
|---|---|---|---|---|
| 5,562,980 | A * | 10/1996 | Koutitonsky | B32B 29/04 428/324 |
| 2006/0133867 | A1* | 6/2006 | Coleman | G03G 15/2028 399/322 |
| 2017/0057721 | A1* | 3/2017 | Lee | B65D 75/5894 |
| 2018/0070595 | A1* | 3/2018 | McCafferty | B65G 19/02 |
| 2020/0357220 | A1* | 11/2020 | Gauger | B65B 25/001 |

* cited by examiner

TRAY PACKAGE UNIT OUTER PACKAGING PAPER AND METHOD FOR PRODUCING SAME

BACKGROUND ON THE INVENTION

The invention relates to a tray package unit outer packaging paper, in particular, to the outer packaging of tray package units, a method for producing a tray package unit outer packaging paper, the use of an outer packaging material for the outer packaging of a tray package unit.

In the attempt to significantly reduce the amount of plastic or plastic materials, suitable substitute materials for plastic are being sought in many areas. For example, replacement solutions are being sought for the plastic films that are ubiquitous in the packaging industry. Due to the inherent properties of plastic films, such as a good deformability with nevertheless good stabilizing properties at the same time when repackaging tray package units, and in addition, a good water tightness or water resistance, the replacement of plastic films by materials having comparable properties has not yet succeeded in many areas. Paper has been suggested as an alternative to plastic films in many areas, not least because of its comparatively good recycling properties. Paper, along with other alternative materials, has also been considered as an alternative for tray package unit outer packagings in the past. In addition to good mechanical properties, alternative materials for use as tray package unit outer packaging materials must also have good resistance to liquids, in particular to water or condensate.

In order to achieve a good water tightness and wet strength of papers, those skilled in the art are familiar with coated paper which, however, cannot be recycled, or only with great effort. In addition, coated papers are also comparatively complex to produce and therefore also expensive and uneconomical. The person skilled in the art is also aware of the use of papers with at least partial cross-linking of the cellulose fibres. In order that the papers for tray package unit outer packaging remain at least temporarily mechanically stable in damp or wet, so-called wet strength agents are added in paper production. In the processing state, wet strength agents are water-miscible polymer solutions that are primarily made from polyamines and epichlorohydrin derivatives. Furthermore, products based on urea formaldehyde or melamine-formaldehyde are also conceivable, which, however, are no longer preferred for reasons of avoiding health risks. When reacting with cellulose fibres, cross-links form between the fibres, which lead to increased water resistance of the corresponding paper. However, this hydrophobic linking prevents easy or successful recycling. A return of used tray package unit outer packaging papers to a pulp cycle is therefore not feasible or only feasible to a limited extent by using high temperatures and/or additional chemicals and additives. Furthermore, a good printability of the tray package unit outer packaging paper is desirable. A disadvantage here is that known tray package unit outer packaging paper cannot be printed, or cannot be printed well.

The experts are aware of hardly any detailed information regarding paper qualities with suitable properties that do not require coatings or wet-strength agents for tray pack unit outer packaging made of paper. Paper is usually only mentioned in general as a possible outer packaging material and is not described in detail. Naturally, due to the specific requirements, not every paper is also suitable as a tray package unit outer packaging material. There is therefore a need for improvement in the area of tray package unit outer packaging materials in the attempt to replace plastic films as the outer packaging material for tray package units.

SUMMARY OF THE INVENTION

The object of the present invention was to overcome the deficiencies of the prior art and to provide a tray package unit outer packaging paper, by means of which tray package units can be repackaged economically and efficiently, wherein a good recyclability combined with high moisture resistance, or wet tensile strength and high mechanical resistance and resilience should be guaranteed. Furthermore, good printability should be ensured. The tray package unit outer packaging paper should therefore basically be suitable as a replacement for plastic films. Furthermore, it was an object of the invention to provide an outer packaging method for tray package units using such a tray package unit outer packaging paper and a method for producing such a tray package unit outer packaging paper.

This object is achieved by a tray package unit outer packaging paper, a packaging method for tray package units, a method for producing a tray package unit packaging paper and by using an outer packaging material for the packaging of a tray package unit according to the claims.

The invention relates to a tray package unit outer packaging paper, which is particularly suitable for the outer packaging of tray package units. The tray package unit outer packaging paper has a first side and a second side and is made from at least one aqueous suspension comprising a pulp material and optional additives. In the case of the tray package unit outer packaging paper according to the invention, at least the first side is compacted with a linear load of 80 kN/m to 500 kN/m. In addition, the tray package unit outer packaging paper has a wet tensile strength index according to ISO 3781:2011 in the machine direction of at least 10 Nm/g.

As is known per se, the terms machine direction and cross direction correspond to the definitions in SCAN-P 9:93, for example.

According to the terminology defined in DIN 55405: 2014, a tray is a synonym for tray, bowl or punnet, depending on the area of application. Accordingly, a tray is a product carrier that can be loaded with packaged goods. In the context of this document, the term packaged goods means goods that are usually already packaged—that is, goods that are included in their sales packaging. The packaged goods are usually accommodated in multiples in a tray. For example, packaged goods can be any type of product-filled cartons or boxes but also cups, bottles, glasses or cans, for example. Packaged goods can be products from the food sector, such as yoghurt pots, beverage bottles, beverage cans, chip bags and the like. Naturally, the packaged goods can also come from the non-food sector. For example, the term packaged goods also includes products such as cosmetic creams in tubes or jars, cans of paint, sprays, shampoo bottles, detergent containers having liquid, pasty or granular contents, to mention just a few examples. Thus, in the context of this document, the term tray package unit means a tray loaded with packaged goods.

The term outer packaging in the sense of DIN 55405:2014 is packaging that is used as additional packaging for sales packaging, i.e. for packaged goods. By definition, outer packaging or secondary packaging is packaging that contains a certain number of sales units or sales packagings or packaged goods which are delivered together at the point of sale to the end customer or consumer or are used only to stock the sales shelves. Outer packaging can be removed from the goods without affecting their properties. The term tray package unit outer packaging paper used in this document is therefore paper which is intended for the outer packaging of tray package units of various sizes and shapes.

The tray package unit outer packaging paper is advantageously particularly dimensionally stable and is therefore readily printable. Good dimensional stability and an associated good and high-quality printability are therefore particularly advantageous because a tray package unit that is enveloped or wrapped in the outer packaging paper and can be printed on for advertising purposes can be presented to the end customer or consumer directly at the point of sale. In particular, the high dimensional stability that can be achieved through the smoothing compaction and the high wet tensile strength index has an advantageous effect on the printability of the tray package unit outer packaging paper both in motif printing and in full tone printing. The tray package unit packaging paper according to the invention can furthermore be produced sustainably and supplied to an environmentally friendly recycling process after use, not least because the required properties of good dimensional stability and a high-quality printable surface are ensured even without the use of wet strength agents.

As a result of the at least one-sided compaction, the tray package unit outer packaging paper is waterproof or water-resistant at least for the duration of its use. It has been found that the compaction of the surface of at least one side brings about a smoothing of the cellulose fibres in the vicinity of the surface. The compaction thereby achieved is equivalent to a type of sealing, which, however, works without any varnish, coatings or similar auxiliary materials. As a result of this type of sealing any undesirable or too rapid penetration of liquids into the tray package unit outer packaging paper or through it to the tray or to the packaged goods is reduced or even completely prevented. Surprisingly, it has been shown that to achieve this "sealing effect" a one-sided compaction and an optionally associated one-sided smoothing of the paper is fundamentally sufficient. Whether compaction on both sides is appropriate depends, inter alia, on the specific application. The compacted side in particular is particularly suitable not least because of its smoothness and also because of its dimensional stability, for high-quality, i.e. register-accurate or perfect-register motif printing, as well as full-tone printing without or largely without randomly based outlet points. Furthermore, the pulp material comprises a pulp mixture of long-fibre pulp, in particular of long-fibre sulphate pulp, having a length-weighted average fibre length in accordance with ISO 16065-2:2014 of 1.50 mm to 3.0 mm. It can also be the case that long-fibre pulp, in particular long-fibre sulphate pulp, forms the only pulp type in the pulp mixture and that the pulp material thus consists of long-fibre pulp, in particular long-fibre sulphate pulp. Sulphate pulp is also known to those skilled in the art under the term Kraft pulp. Whereas experts know that a smooth and therefore easily printable surface can be achieved in particular by adding short-fibre pulp to long-fibre pulp, a sufficiently smooth and therefore easily or even very easily printable surface can be achieved by means of the tray package unit outer packaging paper that is compacted at least on one side even with largely or even with exclusively long-fibre pulp. In particular, the outer packaging paper can be imparted good mechanical properties such as good strength by using a high proportion of long-fibre pulp. Thus, the dimensionally stable and easily printable outer packaging paper can be given improved packaging properties.

Furthermore, the suspension comprises at least one sizing agent as an additive, which sizing agent is added in an amount of 0.05 wt. % to 2 wt. %, relative to the active substance of the sizing agent, relative to 100 wt. % total dry mass of the suspension. The addition of sizing agents to at least one aqueous suspension is also referred to as bulk sizing.

Furthermore, the suspension comprises as additive at least one sizing agent selected from a group consisting of alkenylsuccinic anhydride (ASA), alkyl ketene dimer (AKD), resin sizes or natural sizing agents, or a mixture of sizing agents selected from this group. The said sizing agents can have a particularly advantageous effect on various properties of the tray package unit outer packaging paper. The addition of these sizing agents can have a positive effect on the contact angle of the outer packaging paper. The compacted first side of the outer packaging paper can have a static contact angle according to ISO 19403-2:2020 of at least 100°, preferably at least 110° with water as the test liquid used. The said sizing agents can also have an additional advantageous effect on the printability of the tray package unit outer packaging paper, since on the one hand, an uncontrolled removal of the printing ink or ink into the tray package unit outer packaging paper can be prevented and on the other hand, the dust tendency of the tray package unit outer packaging paper during its production is further reduced. Dust, fibre and fine particles lying freely on the surface of the tray package unit outer packaging paper can lead to defects and random omissions in the printed image because the printing ink or ink cannot reach the paper there. It can thus be prevented that the paper surface of the tray package unit outer packaging paper directly underneath remains unprinted. Furthermore, these dust, fibre and fine particles can further be prevented from depositing and accumulating on printing and motif rollers and thus resulting in the need for more frequent cleaning using cleaning agents in the printing process.

By means of the tray pack unit outer packaging paper according to the invention, a high wet strength is achieved without the addition of synthetic wet strength agents. This property is particularly important in the outer packaging of liquid-containing packaged goods or sales packaging such as bottles, beakers, canisters, cans or the like. When filling and also when storing and transporting liquids or drinks, disadvantages associated with the formation of condensation, which can be a problem especially when the outside temperatures are warm or fluctuating, can be avoided. The tray package unit outer packaging paper which is pressurized or compacted on at least one side according to the invention is also characterized by a high gloss and a high degree of smoothness and thus has a high-quality and attractive appearance for use close to the end customer.

Since no non-recyclable additives such as wet strength agents or the like have to be added to bring about these properties, the tray package unit outer packaging paper according to the invention is also easily accessible to recycling or repulping, i.e. returning to an aqueous pulp suspension. In line with a general trend towards sustainable packaging, tray package unit outer packaging paper can come entirely or at least mainly from sustainable and renewable raw material sources.

As already mentioned, the high wet tensile strength index of the tray package unit outer packaging paper according to the invention ensures a high dimensional stability. The dimensional change of the paper under the influence of moisture absorption caused by ambient change, i.e. its hygroexpansion, is an essential quality feature, particularly for paper to be printed. Mainly local fluctuations of the hygroexpansion, e.g. as a result of local variations in density or fibre orientation can be prevented by the one-sidedly compacted and smoothed tray package unit outer packaging paper having a high wet tensile strength index. In particular, since the paper tends to swell very little due to its high wet tensile strength, register-accurate or perfect-register printing can take place, particularly in motif printing.

Surprisingly, it has been shown that the tray package unit outer packaging paper even has properties that go beyond those of plastic films. For example, paper offers additional protection of the packaged goods against light. This is particularly the case when the tray package unit outer packaging paper is dark or natural brown paper, which can offer good UV protection due to its lignin components. The lignin contents in a natural brown paper determined according to JAYME/KNOLLE/RAPP can be from 1% to 12%. In addition, special natural brown tray package unit outer packaging paper can be particularly resource-saving in production since there is no additional chemical expenditure through bleaching.

The procedure for the gravimetric determination of the lignin content according to JAYME/KNOLLE/RAPP can be deduced from JAYME G., KNOLLE H. and G. RAPP, "Development and final version of the lignin determination method according to JAYME-KNOLLE", The paper 12, 464-467 (1958), No. 17/18. The procedure described therein comprises an extraction using an extraction mixture of methanol and benzene, wherein dichloromethane can be used as the extraction agent instead, as is known per se today and is customary.

Another advantage of the tray package unit outer packaging paper compared to plastic outer packaging is the good dimensional stability at high temperatures or under high temperature fluctuations. The tray package unit outer packaging paper remains substantially more dimensionally stable than outer packaging films since it does not soften like plastic.

Furthermore, it can be expedient if the tray package unit outer packaging paper has a maximum extensibility according to ISO 1924-3:2005 of 2.0% in the machine direction and 2.5% in the cross direction. Surprisingly, the outer packaging paper, which is compacted on at least one side, can have a sufficiently high resistance to crack formation despite a comparatively low elongation at break for use as outer packaging for tray package units and can still have the necessary dimensional stability for a high-quality or register-precise or perfect-register printability.

Furthermore, it can be provided that at least the first side is thermally treated in the course of compaction. Such a thermal treatment can preferably also be carried out in several steps. In particular, a thermal treatment can be carried out at a temperature of 90° C. to 97° C. and/or at a temperature of 150° C. to 295° C. A thermal treatment taking place additionally to or even simultaneously with the pressurization or compaction can have a beneficial effect on the water resistance of the tray package unit outer packaging paper. This can be achieved whereby the influence of heat can bring about an additional smoothing or a further compaction of the surface of at least the first side. This additional compaction and smoothing effect can therefore also be advantageous with regard to a high-quality and optionally also printable surface.

In addition to long-fibre pulp, the pulp mixture can also include short-fibre pulp, in particular short-fibre sulphate pulp, and the printability can thus be further improved. Accordingly, an embodiment can also be advantageous according to which the pulp mixture contains 10 wt. % to 90 wt. % long-fibre pulp, preferably 50 wt. % to 90 wt. % long-fibre sulphate pulp, and 10 wt. % to 90 wt. % short-fibre pulp, preferably 10 wt. % to 50 wt. % short-fibre sulphate pulp. A mixture within the specified limits has proven to be particularly advantageous in practice for achieving good compactability or a smooth and easily printable surface.

Furthermore, it can be provided that the suspension is produced with a consistency of 0.15% to 0.50%. This means that the suspension has an amount of pulp in water of 1.5 g/l to 5.0 g/l. Depending on which specific method is used for the compaction step, it can be advantageous if the aqueous suspension is produced as a low-consistency suspension having a consistency of 0.15% to 0.25% or as a high-consistency suspension having a consistency of up to 0.50%. The consistency selected in each case can depend on the machine type, the fibrous material mixture, the drying capacity of the machine and other parameters.

Furthermore, it can be provided that the compacted first side has a Cobb 1800s value according to ISO 535:2014 of 35 g/m$^2$ to 70 g/m$^2$. As a result of the fact that the Cobb 1800s value according to ISO 535:2014 represents an absolute value of the water absorption capacity of a paper, and the grammage of the paper can play a significant role here or have a substantial influence on this absolute value, for a better comparability between different papers, a percentage water content over the entire grammage range can also be meaningful for characterizing the paper properties. Such a percentage water content can be calculated from the relationship between a measured Cobb 1800s value according to ISO 535:2014 and the grammage of the paper. In particular, a percentage water content of 38% to 52% can be advantageous for a paper—this is assuming that 7% water in the paper is present as equilibrium moisture content when stored in a climate of 23° C.±1° C. and 50%±2% relative humidity according to ISO 187:1990. Three calculation examples for various outer packaging papers are given hereinafter for explanation as examples:

Example 1

Grammage when stored in a standard climate at 23° C.±1° C. and 50%±2% relative humidity according to ISO 187:1990=50.0 g/m$^2$ Cobb 1800s value according to ISO 535:2014=44.2 g/m$^2$ Grammage of the paper according to the Cobb 1800s test=94.2 g/m$^2$ Total water content in the paper according to the Cobb 1800s test=((50.0/100*7)+44.2)/94.2 *100=50.6%

Example 2

Grammage when stored in a standard climate at 23° C.±1° C. and 50%±2% relative humidity according to ISO 187:1990=120.0 g/m$^2$ Cobb 1800s value according to ISO 535:2014=67.1 g/m$^2$ Grammage of the paper according to the Cobb 1800s test=187.1 g/m$^2$ Total water content in the paper according to the Cobb 1800s test=40.35%

Example 3

Grammage when stored in a standard climate at 23° C.±1° C. and 50%±2% relative humidity according to ISO 187:1990=91.0 g/m$^2$ Cobb 1800s value according to ISO 535:2014=56.5 g/m$^2$ Grammage of the paper according to the Cobb 1800s test=147.5 g/m$^2$ Total water content in the paper according to the Cobb 1800s test=42.6%

According to a particular embodiment, it is possible that a difference in a Cobb 1800s value according to ISO 535:2014 between the compacted first side and the non-compacted or less strongly compacted second side is a maximum of 3 g/m$^2$. Less strongly compacted means that the second side is less compacted compared to the first side since it is not pressed against a smooth surface, for example. According to the manufacturing processes and machine concepts, papers according to the invention having grammages of preferably from 50 g/m$^2$ to 120 g/m$^2$ according to ISO 536:2019 can be used for production of tray package units outer packaging papers. In principle, however, the use of papers having lower but also having higher grammages is naturally also conceivable and possibly expedient.

According to an advantageous further development, it can be provided that the compacted first side has a Bendtsen roughness according to ISO 8791-2:2013 of 100 ml/min to 450 ml/min.

In particular, it can be advantageous if the tray package unit outer packaging paper has a gloss value of 21% to 33% according to TAPPI T 480:2015. It can be particularly advantageous in a manufacturing process using shoe calenders if a gloss value according to TAPPI T 480:2015 is from 21% to 25%. When manufacturing MG papers, it can be expedient if the gloss value is from 24% to 33% according to TAPPI T 480:2015.

Furthermore, it can be provided that the tray package unit outer packaging paper has a bending resistance index according to ISO 2493-1:2010 using a bending angle of 15° and a test bending length of 10 mm of 210 Nms/kg$^3$ to 330 Nms/kg$^3$ in the machine direction and of 110 Nms/kg$^3$ to 160 Nms/kg$^3$ in the cross direction. A low bending resistance of the tray package unit outer packaging paper can delay or even prevent the formation of predetermined tear lines in the outer packaging paper in the area of corners and edges of a tray package unit. As a result, outer packagings with a substitute material for plastic films can be provided with improved efficiency, also from an economic point of view.

In addition, it can be provided that the tray package unit outer packaging paper has a grammage according to ISO 536:2019 from 50 g/m$^2$ to 120 g/m$^2$, preferably from 60 g/m$^2$ to 110 g/m$^2$, particularly preferably from 70 g/m$^2$ to 100 g/m$^2$.

Also advantageous is an embodiment according to which it can be provided that a ratio of tear resistance according to ISO 1974:2012 in the machine direction to tear resistance according to ISO 1974:2012 in the cross direction is from 0.6 to 1.1. As a result of this characteristic, any tear and crack propagation can be kept as small as possible or prevented.

In addition, it can be provided that at least the compacted first side can be printed with colour densities of at least 1.0, i.e. colour densities of greater than or equal to 1.0, for example, can be achieved in the flexographic printing process.

The person skilled in the art knows that the colour density, solid tone density or also the optical density D according to KIPPHAN H. "Handbuch der Printmedien" (2000) is defined as a logarithmic ratio and reflects the thickness of a colour film.

$$D=\log(1/R)=\log(I_0/I)$$

Here, the remission R is the ratio of the light intensity I of the light reflected from the ink layer in relation to the remission $I_0$ of the unprinted paper. To simulate non-linear human visual perception, the ratio is taken as a logarithm. In this case, it holds that the thicker the colour layer, the lower the remission and the higher the colour density.

The tray package unit outer packaging paper, which is pressurized or compacted at least on one side, can also be characterized by a high gloss and a high smoothness. A high-quality printed surface can be desirable, particularly if the tray package unit wrapped with the outer packaging paper is used as sales packaging close to the customer, for example on a shop shelf. Surfaces that can be printed with good quality are particularly important for high-quality articles and branded products, particularly when they are presented to the end customer. In particular, the tray package unit outer packaging paper can also be produced dust-free, which can also be guaranteed by the compaction. A surface can thus be achieved which has no loose fibre particles and is therefore extremely well suited for any printing. This is mainly because the surface has no or only minor irregularities that can cause colour defects. A printability in which a screen print can be achieved, for example in the flexographic printing process, with at least 200 lines/cm can be of particular advantage.

In a packaging method for tray package units a procedure is provided in which a tray package unit is initially provided. This comprises a tray, in particular a bowl, a punnet or a tray, which tray is equipped with packaged goods. Furthermore, the tray package unit is positioned in an outer packaging device and the tray package unit is enveloped or wrapped with one or more layers of an outer packaging material. A tray package unit outer packaging paper according to the claims is used as the outer packaging material here.

The precise implementation and also the equipment used to implement the outer packaging process can be of a diverse nature, wherein numerous outer packaging processes and equipment for performing outer packaging are known to the person skilled in the art from the prior art. Naturally, the repackaging process, in particular the step of wrapping or enveloping or wrapping a tray package unit can in principle also be carried out manually. In particular, when the tray package unit is wrapped in one or more layers of the tray package unit outer packaging paper, so-called fold-wrapping machines are preferably used here. If the tray package unit is wrapped with one or more layers of the tray package unit outer packaging paper, this can be accomplished, for example, by means of a turntable. If several layers or wraps are realized by using several separate individual pieces of the tray package unit outer packaging paper, these individual pieces can be of the same size or have different dimensions. This can be adapted to the respective type and shape of the tray package unit to be repackaged.

The object of the invention is additionally and just as independently achieved by a method for producing a tray package unit outer packaging paper, which tray package unit outer packaging paper is particularly suitable for the packaging of tray package units. According to the method, a pulp material consisting of or comprising a pulp mixture of long-fibre pulp, in particular long-fibre sulphate pulp having a length-weighted average fibre length according to ISO 16065-2:2024 of 1.5 mm to 3.0 mm is provided, at least one aqueous suspension comprising the pulp material and additions of additives to the suspension, comprising at least a sizing agent, which sizing agent is provided relative to the active substance of the sizing agent in a quantity of 0.05 wt. % to 2 wt. % relative to 100 wt. % total dry mass of the suspension, is provided, wherein the at least one sizing agent is selected from the group of alkenyl succinic acid anhydride (ASA), alkyl ketene dimer (AKD), resin sizes or natural sizing agents or a mixture of sizing agents selected from this group t, the at least one aqueous suspension is homogenised and pre-dried to form at least one water-containing nonwoven web having a first side and a second side, the at least one paper web is further processed to form a tray package unit outer packaging paper.

According to the invention, at least the first side of the at least one nonwoven web is compacted with a linear load of 80 kN/m to 500 kN/m before, during or after one of the drying steps and before further processing to form a tray package unit outer packaging paper. In addition, a wet tensile strength index according to ISO 3781:2011 in the machine direction of at least 10 Nm/g is imparted to the tray package unit outer packaging paper.

As a result of the specified measures a tray package unit outer packaging paper having sufficient properties for packaging tray package units can be produced. The advantages that can be achieved with such a tray package unit outer packaging paper have already been described above. In particular, a tray package unit outer packaging paper having sufficiently good water resistance and wet tensile strength and in addition sufficient strength or dimensional stability and the associated good printability can be produced. The tray package unit outer packaging paper has thus proven to be both damage-resistant and water-resistant when wrapping tray package units and can also be equipped with a visually appealing, high-quality printed surface.

Despite the compaction on one side, the tray package unit outer packaging paper can be particularly low-tension or even tension-free. This is particularly the case if the drying in the course of the at least one drying step is subject to very good, i.e. very uniform, process control. A uniformly dried and thus low-tension or tension-free paper can have particularly good packaging properties.

At least one of the drying steps can also take place as so-called clamped drying, in which case a good flat position of the nonwoven web or the paper web can be expedient. A paper with low hygroexpansion can be produced, for example, whereby by means of a fixing agent, such as a drying wire, for example, a free contact is established between the nonwoven web to be dried and a hot drying surface of a roller.

In particular, it can be advantageous if at least one nonwoven web is compacted by means of a wide nip calender having a heated roller and a shoe roll which interacts with the heated roller and forms a wide nip, the at least one nonwoven web being guided through the wide nip calender with its first side facing the heated roller. Such processing by means of a wide nip calender, which, for example, can be a shoe calender or metal belt calender, can usually take place at the end of a drying section.

Furthermore, it can be provided that at least one nonwoven web is pressed with its first side against the surface of a heated drying cylinder by means of one or more pressure rollers, wherein the at least one nonwoven web is guided over a large part of the circumference of the drying cylinder and additionally heated from outside by means of a drying hood at least partially surrounding the drying cylinder. The drying cylinder can be a so-called Yankee cylinder, for example, or drying cylinders are also known as Yankee cylinders. A uniform drying or thermal treatment of both sides can have an advantageous effect on the dimensional stability of the paper. So-called "MG papers" ("machine-glazed" papers) or calendered papers can also be produced with low grammages and are generally easily printable.

Regardless of the compaction process, it can be advantageous if the at least one aqueous suspension is homogenized and pre-dried to form at least one water-containing nonwoven web. This can usually be accomplished in a wire section, in particular by application to an endless wire of a wire section. In the course of the subsequent compaction—for example by means of a wide nip calender and/or by means of heated drying cylinders—either the side facing the wire of the wire section can then be compacted or the side facing away from the wire. Naturally, it can also be expedient if both sides are compacted, in which case the compaction does not have to be of the same intensity. In principle, the actual process management depends on the manufacturing process and the selected compaction concept.

In addition, the object of the invention is also achieved whereby an outer packaging material is used for the outer packaging of a tray package unit, the tray package unit comprising a tray, in particular a bowl, a punnet or a tray, which tray is equipped with packaged goods. It is provided that a tray package unit outer packaging paper according to one of the claims is used as the outer packaging material. The advantages that can be achieved by using such an outer packaging material have already been described above.

DESCRIPTION OF THE DRAWINGS

For a better understanding of the invention, this is explained in further detail with reference to the following figures.

They each show in a highly simplified, schematic representation.

Firstly, it should be noted that in the differently described embodiments, the same parts are provided with the same reference numbers or the same component designations, wherein the disclosures contained throughout the description can be applied accordingly to the same parts with the same reference numbers or the same component designations. The positional information selected in the description, such as top, bottom, side, etc. are related to the directly described and illustrated figure and this positional information can be transferred accordingly to the new position in the event of a change in position.

The term "in particular" is understood hereinafter to mean that it can be a possible more specific configuration or more detailed specification of an object or a method step, but does not necessarily have to represent a mandatory, preferred embodiment of the same or a mandatory procedure. In their present usage, the terms "comprising," "comprises," "having," "includes," "including," "includes," "containing," and any variations thereof are intended to cover a non-exclusive inclusion.

Finally, it should also be mentioned that the individual method steps and their chronological sequence do not necessarily have to take place in the order listed, but a different chronological sequence is also possible. However, a successive and thus consecutive chronological sequence of the cited method steps preferably takes place.

DETAILED DESCRIPTION OF THE DRAWINGS

Figure 1:
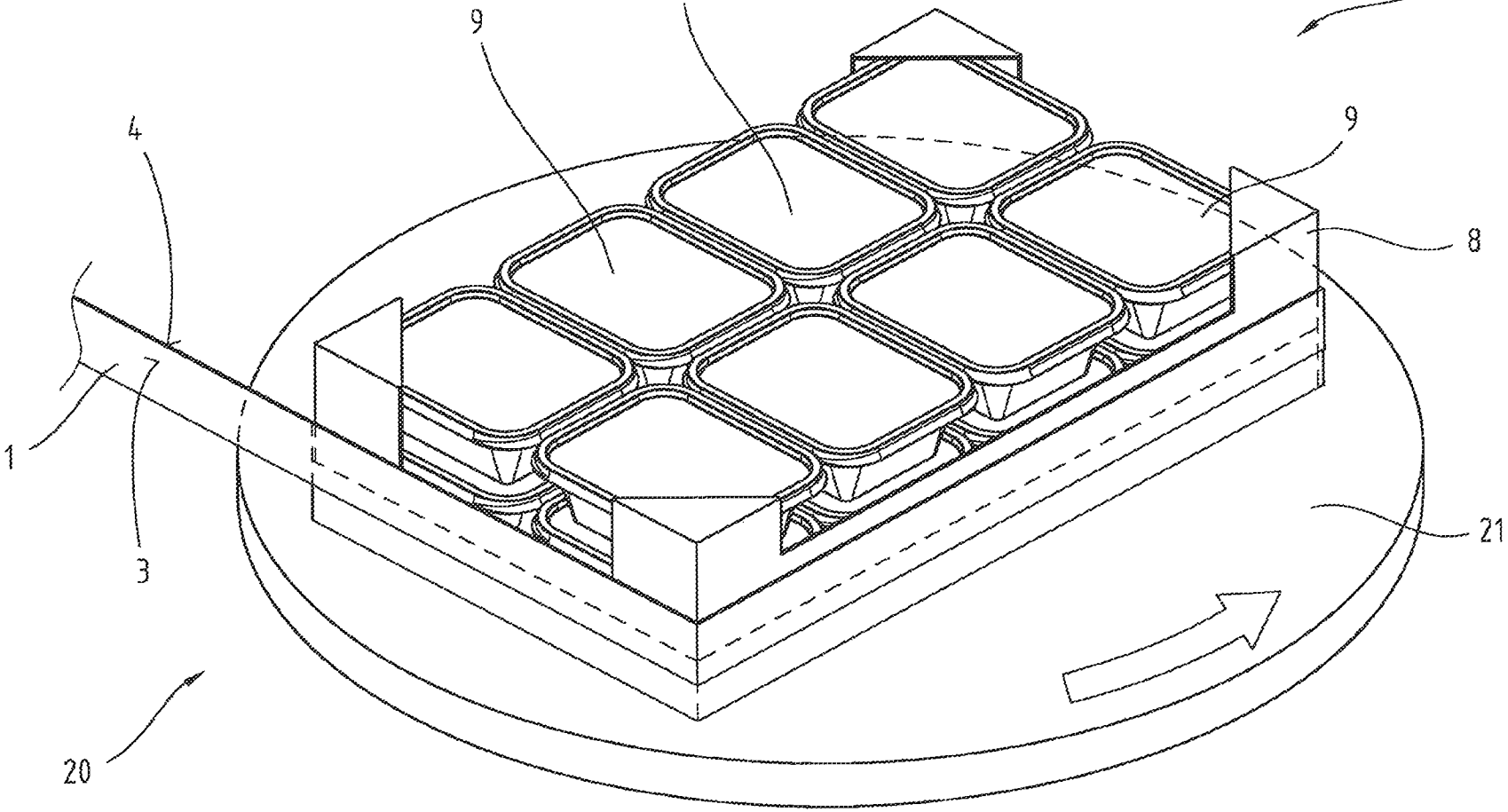
FIG. 1 shows an exemplary embodiment for an outer packaging method using an exemplary tray package unit outer packaging device in part.

FIG. 1 shows in part and highly schematically an exemplary embodiment of an outer packaging method with reference to a typical tray package unit outer packaging device 20 or station. As shown, in a typical outer packaging method, a tray 8, in particular a bowl, a punnet or a tray, with packaged goods 9 received or stacked thereon or therein, i.e. an equipped tray 8 or a tray package unit 2, is provided and placed in a tray package unit outer packaging device 20. In the depicted embodiment, the tray package unit 2 can be positioned on a rotatable, driven turntable 21. The tray package unit 2 shown in FIG. 1 has a cuboid shape in the depicted embodiment. Such a tray package unit 2 can be wrapped with an outer packaging material by rotating the turntable 21. The outer packaging material can, for example, be pulled off from a roll, not shown, and arranged on the tray package unit 2 with guide mechanisms, also not shown in detail, and a pre-tensioning device so that it can be adjusted in height and wound around the tray package unit 2 by rotating the turntable 21 as indicated in FIG. 1. In this case, the tray package unit 2 can be wrapped with one or more layers of outer packaging material. Wrapping can preferably take place not only horizontally around the tray package unit 2, as shown, but also vertically so that the packaged goods 9 arranged or accommodated in the tray 8 cannot fall out. The terms horizontal and vertical refer to the orientation of the tray package unit 2 shown in FIG. 1. If necessary, several individual or partial pieces of the tray package unit outer packaging paper 1 are used and thus a multi-layer packaging can be produced. Depending on the size and type of the packaged goods 9, it can also be sufficient if the tray package unit 2 is not fully, i.e. not completely but only partially wrapped with the tray package unit outer packaging paper 1. In particular, if the tray package unit 2 is not completely wrapped, it can also be expedient if a cover element—not shown in the figure—is arranged on the tray package unit 2 or on the uppermost layer of the packaged goods 9. The position description "on the tray package unit 2" is naturally also related here to the orientation of the tray package unit 2 shown in FIG. 1. Such a cover element can be a cover paper or a cover carton and preferably also the tray package unit outer packaging paper 1. A cover element can also have a cutting pattern or a fold, as a result of which the cover element can be folded and thus at least partially cover both the top side and the side surfaces of the tray package unit 2. It can be sufficient if only the side surfaces and not also the top and bottom of the tray package unit 2 are wrapped with the tray package unit outer packaging paper 1 and as a result of the cover element protruding into the side surfaces, any falling out of the packaged goods 9 can nevertheless be prevented. In the present invention, the outer packaging material is formed by a tray package unit outer packaging paper 1 as described hereinabove and also hereinbelow. As illustrated in FIG. 1, the tray package unit outer packaging paper 1 is intended in particular for the outer packaging of tray package units 2.

Figure 2:
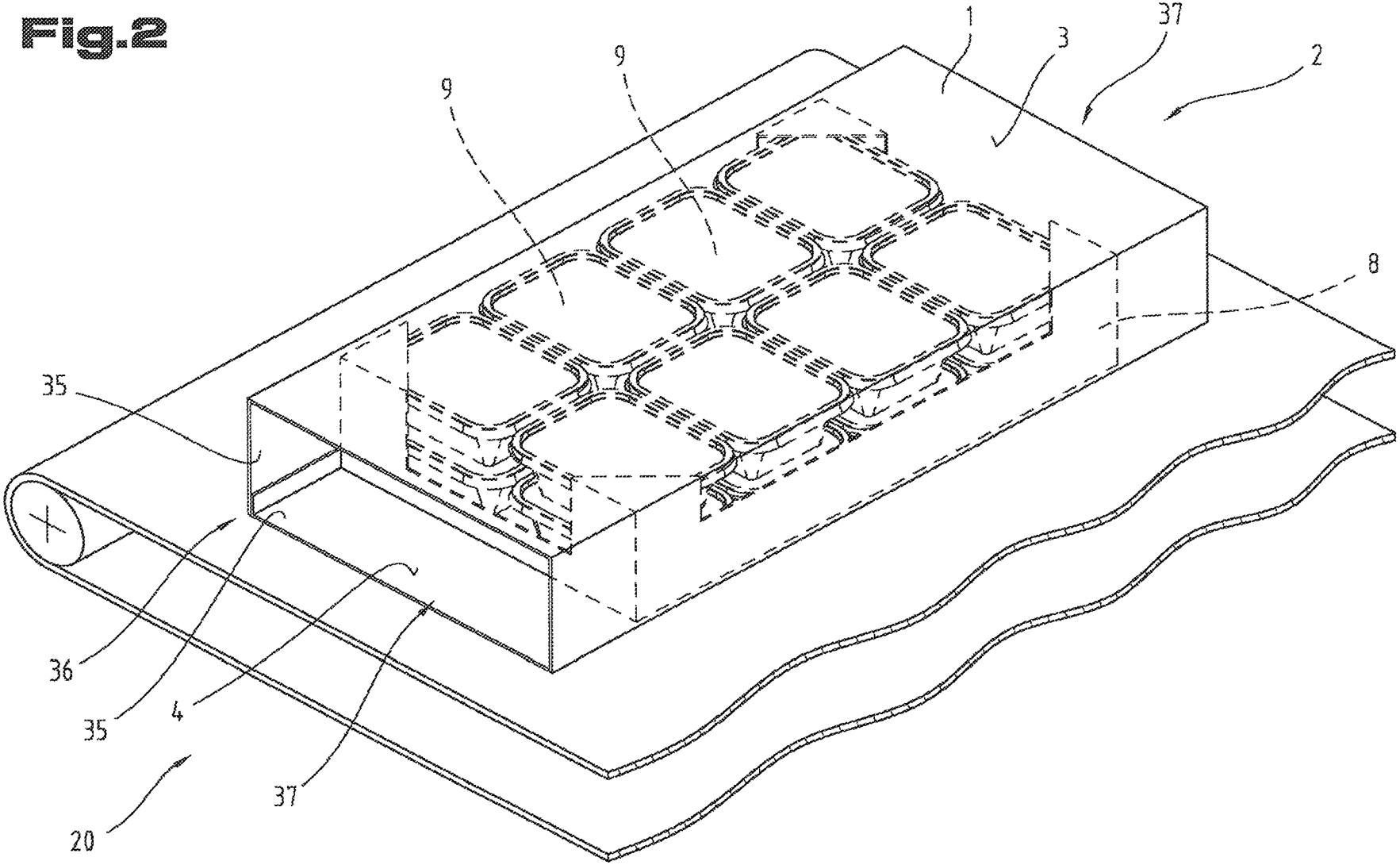
FIG. 2 shows a further exemplary embodiment of an outer packaging method using an exemplary tray package unit outer packaging device in part.
Figure 3:
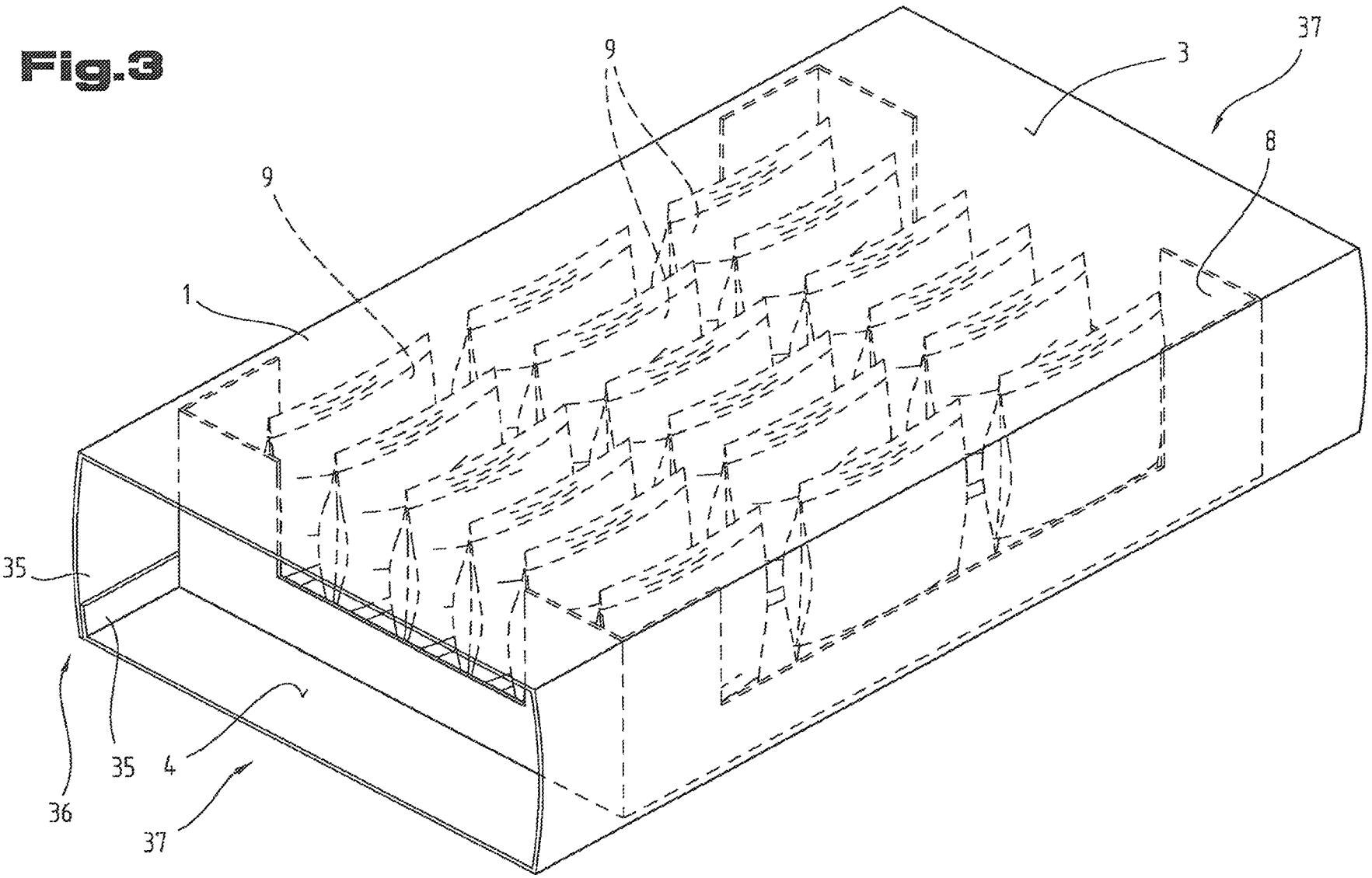
FIG. 3 shows an exemplary embodiment of a tray package unit wrapped with tray package unit outer packaging paper.
Figure 4:
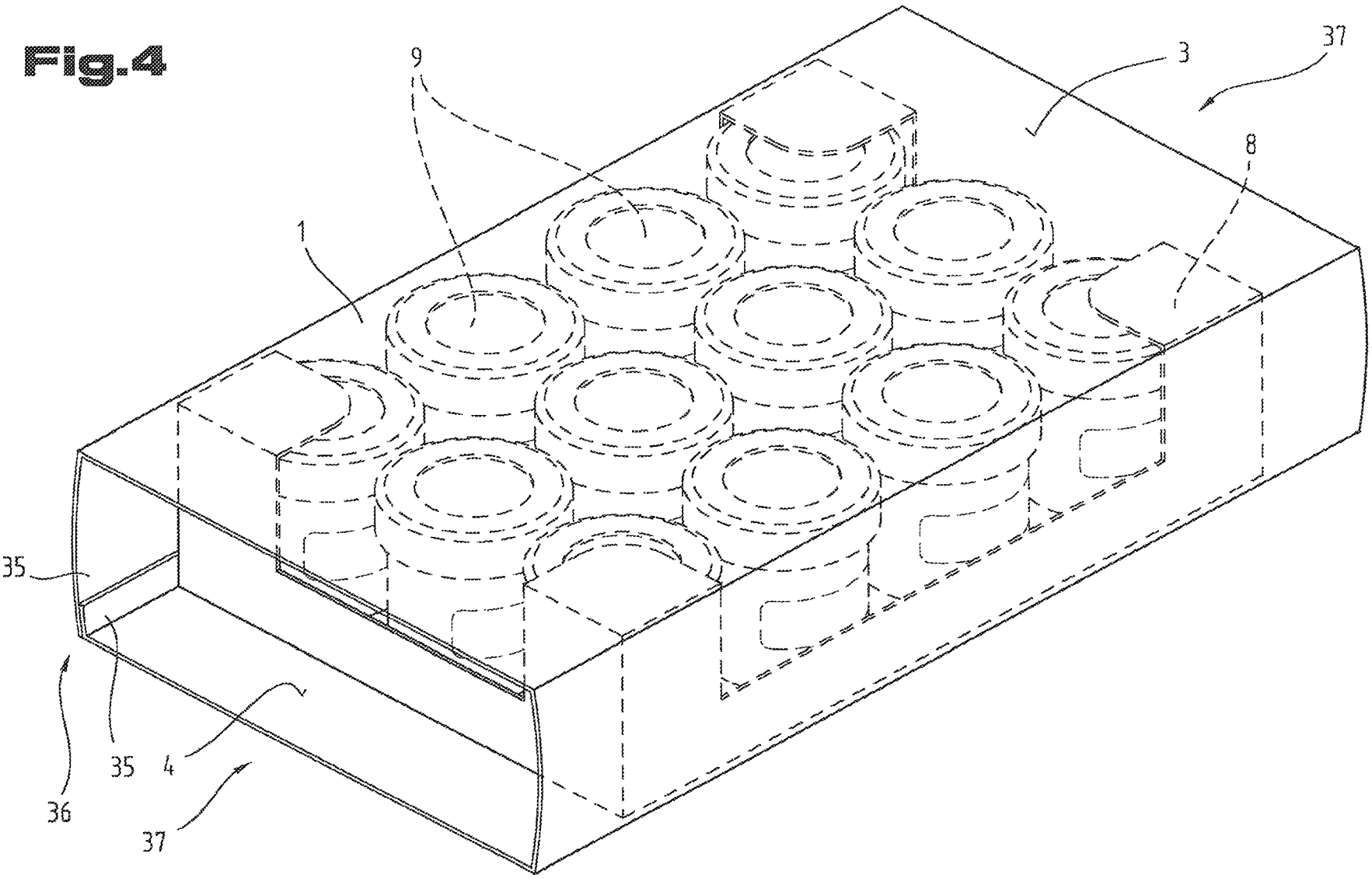
FIG. 4 shows a further exemplary embodiment of a tray package unit wrapped with tray package unit outer packaging paper.
Figure 5:
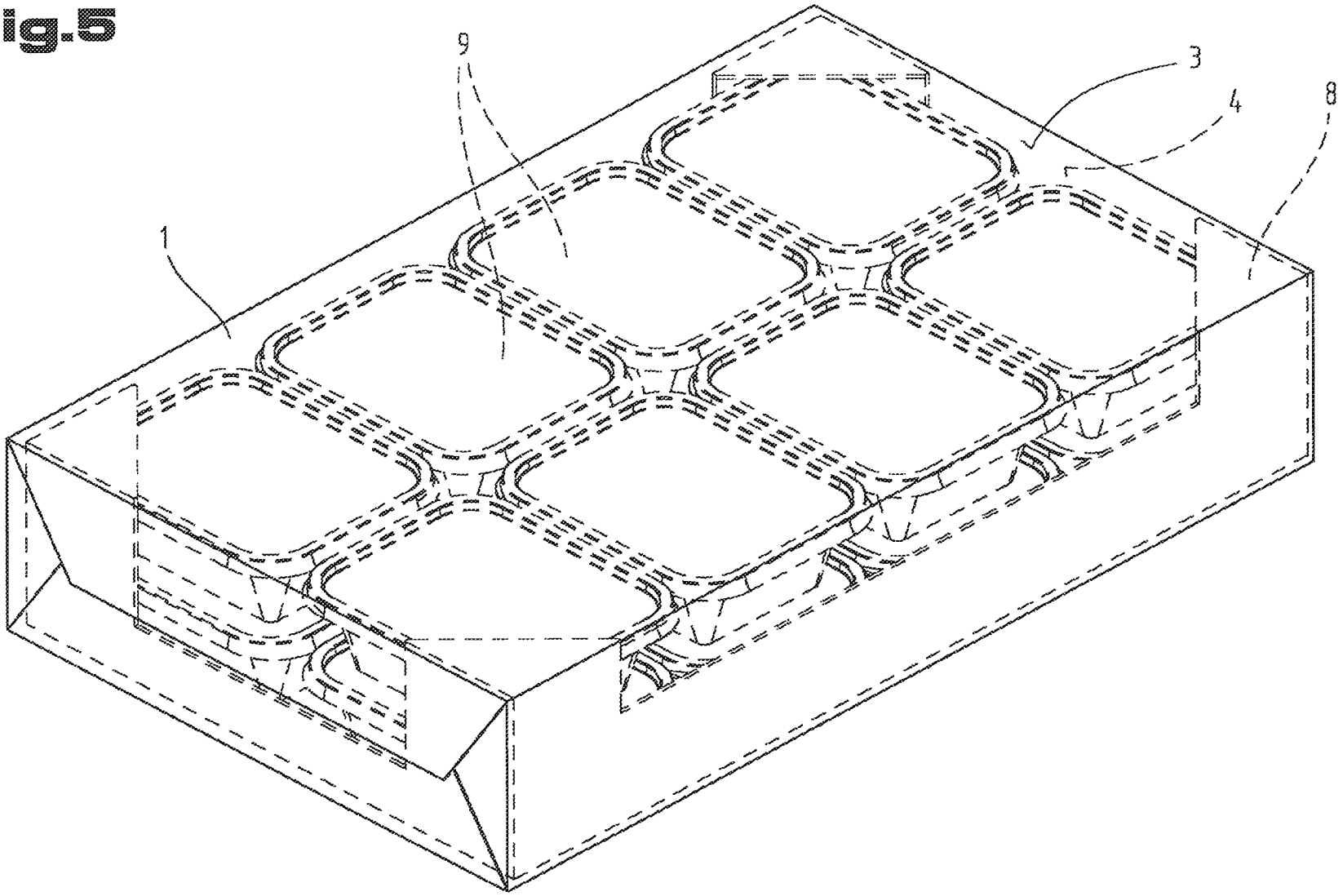
FIG. 5 shows a further exemplary embodiment of a tray package unit wrapped with tray package unit outer packaging paper.

As an alternative to the method shown in FIG. 1 for wrapping a tray package unit 2 with the tray package unit outer packaging paper 1, FIG. 2 shows a partial process step of a wrapping of a tray package unit 2 in a tray package unit outer packaging paper 1. For this purpose, a fold-wrapping machine, not shown in detail because it is sufficiently known in the technical field, can be used as the tray package unit outer packaging device 20. FIG. 2 shows only a schematic partial section of a fold wrapping machine configured as a tray package unit outer packaging device 20 with a conveyor belt. The tray package unit 2 can be wrapped in at least one piece of tray package unit outer packaging paper 1 so that the two ends 35 of the tray package unit outer packaging paper 1 touch one another or overlap one another. The overlapping area 36 can, for example, also be glued or folded or wrapped in such a way that the ends 35 are coupled or fixed. As outlined in FIG. 2, the tray package unit outer packaging paper 1 can enclose the tray package unit 2 in a quasi-hose or tube-like manner. In a further, outer packaging step, not shown, the protruding openings 37 can be wrapped or folded in the form of a package—if necessary with the aid of adhesives or fixing agents—so that the tray package unit 2 is preferably completely wrapped in the tray package unit outer packaging paper 1. A tray package unit outer packaging paper 1 with sealed openings 37 wrapped in a package is shown in FIG. 5 as an example. FIGS. 3 and 4 each show tray package units 2 during the repackaging or during wrapping with the tray package unit outer packaging paper 1, wherein the openings 37 are not yet fully folded or wrapped.

FIGS. 3, 4 and 5 each show exemplary embodiments of tray package units 2 repackaged with the tray package unit outer packaging paper 1, in particular wrapped in the tray package unit packaging paper 1. It is shown that packaged goods 9 received in or on the respective tray 8 can be of different types and shapes. Thus, the tray 8 shown in FIG. 3 is equipped with packs or bags whilst the tray 8 in FIG. 4 for example, holds cans, cups, glasses or bottles. Such cans, beakers, glasses or bottles can, as is known, be received in the tray 8 in receiving openings provided for this purpose. FIG. 5 shows that a tray 8 can also be equipped or filled with cartons or boxes. Since the respective tray package units 2 are completely or at least largely repackaged with the tray package unit outer packaging paper 1 or are wrapped in this, the respective packaged goods 9 cannot fall out of the tray 8. Whilst the tray package units 2 shown in FIGS. 3, 4 and 5 are each shown completely filled, which can be in particular in terms of efficient transport logistics, it would also be possible and possibly advantageous if the tray package units 2 were not completely filled. It would also be possible for the tray package units 2 to be loaded with different types of packaged goods 9, for example bottles and packages. In principle, the tray package unit outer packaging paper 1 also does not have to be completely removed in order to remove packaged goods 9.

In order to avoid unnecessary repetition, FIGS. 1 to 5 are described hereinafter in a combined view, with the same reference numbers or component designations being used for the same parts. In particular, it should be mentioned at this point that the areas of the tray package units 2 that are repackaged or covered by the tray package unit outer packaging paper 1 are only shown as dashed lines for better understanding. The tray package unit outer packaging paper 1 is preferably designed to be non-transparent, opaque or only slightly transparent and is also printed. For this reason, the underlying tray package unit 2 is preferably not visible The tray package unit outer packaging paper 1 according to the invention has a first side 3 and a second side 4 opposite the first side 3 and is made from at least one aqueous suspension 5 comprising a pulp material 6 and optional additives 7. At least the first side 3 of the tray package unit outer packaging paper 1 is compacted with a linear load of 80 kN/m to 500 kN/m. In addition, the tray package unit packaging paper 1 has a wet tensile strength index according to ISO 3781:2011 in the machine direction of at least 10 Nm/g. FIGS. 1 to 5 show that the respective tray package unit 2 is repackaged in the course of a packaging process with the tray package unit outer packaging paper 1 in such a manner that the compacted first side 3 is on the outside, or that the non-compacted or less highly compacted second side 4 faces the tray packing unit 2. This can be expedient in particular when the compacted and therefore also smoothed first side 3 is printed. Naturally, a precisely reverse arrangement would also be conceivable and possibly expedient. In principle, tray package unit outer packaging paper 1 compacted on both sides can also be used. Alternatively, the tray package unit 2 can also be wrapped with several layers of a tray package unit outer packaging paper 1 or wrapped in this, in which case these several layers can be oriented in the same way, i.e. can each be arranged with its compacted first side 3 facing outwards, for example. or can also be arranged arbitrarily alternately once with its compacted first side 3 outwards and once with its compacted first side 3 inwards.

The tray package unit outer packaging paper 1 can have a maximum extensibility according to ISO 1924-3:2005 of 2.0% in the machine direction and 2.5% in the cross direction. At least the first side 3 can be thermally treated in the course of compaction. A thermal treatment can preferably take place at a temperature of 90° C. to 97° C. and/or at a temperature of 150° C. to 295° C.

The pulp material 6 can be a pulp mixture comprising or consisting of long-fibre pulp, in particular long-fibre sulphate pulp, with a length-weighted average fibre length according to ISO 16065-2:2014 of 1.50 mm to 3.0 mm. It would also be conceivable that the pulp mixture contains 10 wt. % to 90 wt. % long-fibre pulp, preferably 50 wt. % to 90 wt. % long-fibre sulphate pulp, and 10% to 90 wt. % short-fibre pulp, preferably 10% to 50 wt. % short-fibre sulphate pulp. The suspension 5 can be produced with a consistency of 0.15% to 0.50%.

The suspension 5 can comprise at least one sizing agent as an additive 7, which sizing agent, relative to the active substance of the sizing agent, is added in an amount of 0.05 wt. % to 2 wt. %, relative to 100 wt. % total dry mass of the suspension 5. Alternatively or additionally, the suspension 5 can comprise at least one sizing agent selected from a group consisting of alkenylsuccinic anhydride (ASA), alkyl ketene dimer (AKD), resin sizes or natural sizing agents, or a mixture of sizing agents selected from this group as additive 7.

The compacted first side 3 can have a Cobb 1800s value according to ISO 535:2014 from 35 g/m$^2$ to 70 g/m$^2$. A difference in a Cobb 1800s value according to ISO 535:2014 between the compacted first side 3 and the uncompacted or less strongly compacted second side 4 can amount to a maximum of 3 g/m$^2$.

The compacted first side 3 can have a Bendtsen roughness according to ISO 8791-2:2013 of 100 ml/min to 450 ml/min.

The tray package unit outer packaging paper 1 can be characterized by a gloss value according to TAPPI T 480: 2015 of 21% to 33%.

The tray package unit outer packaging paper 1 can have a bending resistance index according to ISO 2493-1:2010 using a bending angle of 15° and a test bending length of 10 mm from 210 Nm$^6$/kg$^3$ to 330 Nm$^6$/kg$^3$ in the machine direction and from 110 Nm$^6$/kg$^3$ to 160 Nm$^6$/kg$^3$ in the cross direction.

It can also be the case that the tray package unit outer packaging paper 1 has a grammage according to ISO 536: 2019 from 50 g/m$^2$ to 120 g/m$^2$, preferably from 60 g/m$^2$ to 110 g/m$^2$, particularly preferably from 70 g/m$^2$ to 100 g/m$^2$ A ratio of ISO 1974:2012 tear resistance in the machine direction to ISO 1974:2012 tear resistance in the cross direction can be 0.6 to 1.1

At least the compacted first side 3 can be printable with full tones, for example in the flexographic printing process with colour densities of at least 1.0.

A method for producing tray package unit outer packaging paper 1, in particular for packaging tray package units 2, can in principle be carried out in or by means of a paper machine 22. The basic structure and basic sequences in such a paper machine 22 are known to the person skilled in the art from the field of papermaking. Therefore, only a summary of the method for producing the tray package unit outer packaging paper 1 is described hereinafter, with some method steps being explained in more detail. The method can be provided in particular for the production of a tray package unit outer packaging paper 1 as described above.

As is known per se, the method comprises steps for providing a pulp material 6 and steps for producing at least one aqueous suspension 5 comprising the pulp material 6. An admixture of additives 7 to the suspension 5 is optionally possible here. The at least one aqueous suspension 5 is homogenized and pre-dried to form at least one water-containing nonwoven web 10 having a first side 3 and a second side 4. The at least one water-containing nonwoven web 10 is dried in several drying steps to form at least one paper web 11 having a first side 3 and a second side 4. Furthermore, the at least one paper web 11 is processed further to form a tray package unit outer packaging paper 1.

It is provided that at least the first side 3 of the at least one nonwoven web 10 is compacted before, during or after one of the drying steps and before further processing to form a tray package unit outer packaging paper 1 with a linear load of 80 kN/m to 500 kN/m. Here, the tray package unit packaging paper 1 is imparted a wet tensile strength index according to ISO 3781:2011 in the machine direction of at least 10 Nm/g.

As already mentioned, the average person skilled in the art is sufficiently familiar with how the pulp material 6 can be produced, which is why the corresponding possible method steps are not described in detail and are also not shown in the figures. For the sake of completeness, a possible process sequence is only briefly outlined at this point. The pulp material 6 can be a pulp mixture of long-fibre pulp, in particular long-fibre sulphate pulp or a pulp mixture of long-fibre pulp, in particular long-fibre sulphate pulp and short-fibre pulp, preferably short-fibre sulphate pulp can be provided. Long-fibre pulp or long-fibre sulphate pulp preferably has a length-weighted average fibre length according to ISO 16065-2:2014 of 1.50 mm to 3.0 mm. The pulp mixture can consist of 10 to 90 wt. % long-fibre pulp, in particular from 50 wt. % to 90 wt. % long-fibre sulphate pulp and from 10% to 90 wt. % short-fibre pulp, in particular from 10 wt. % to 50 wt. % short-fibre sulphate pulp. As a starting material for producing the pulp material 6, for example, a pulp mixture of comminuted hardwood can be used as sulphate pulp and comminuted softwood can be used as sulphate pulp. Naturally, it can also comprise a mixture of different comminuted hardwoods and softwoods. This pulp mixture is prepared by a process comprising chemically treating the comminuted first and second pulps in a digester. Depending on the requirements, it can be expedient if, after the chemical treatment, a mechanical processing and defibration of an aqueous solid suspension of the pulp mixture is carried out in a high-consistency pulper. For example, a consistency of the solid suspension before mechanical processing and defibration in the high-consistency pulper can be adjusted to 25% to 40%. Such defibration in a high-consistency pulper serves, inter alia, to reduce the so-called splinter content of the pulp mixture, i.e. to break up pulp agglomerates that are still wood-like. In addition, it can also be expedient if, after the first mechanical processing and defibration in the high-consistency pulper, the pulp mixture or an aqueous solid suspension of the pulp mixture is mechanically processed and ground in a low-consistency refiner. A consistency of the solid suspension before mechanical processing and grinding in the low-consistency refiner can expediently be adjusted to 2% to 6%. As an alternative or in addition, processing in a medium-consistency pulper is also possible and, if appropriate, expedient. For example, a consistency of the solid suspension prior to mechanical processing and defibration in a medium-consistency pulper can be adjusted to 10% to 15%. It can certainly also be provided that the mechanical processing of the pulp mixture is carried out in a high-consistency pulper or a medium-consistency pulper. In the same way, however, it can also be appropriate if defibration in a high-consistency pulper or medium-consistency pulper is superfluous and only mechanical processing of the pulp mixture is carried out in a low-consistency refiner. In principle, every conceivable combination of grindings is possible, wherein the specific grinding performance of the individual grinding stages has to be adapted to the selected pulp mixture and the desired paper parameters.

Figure 6:
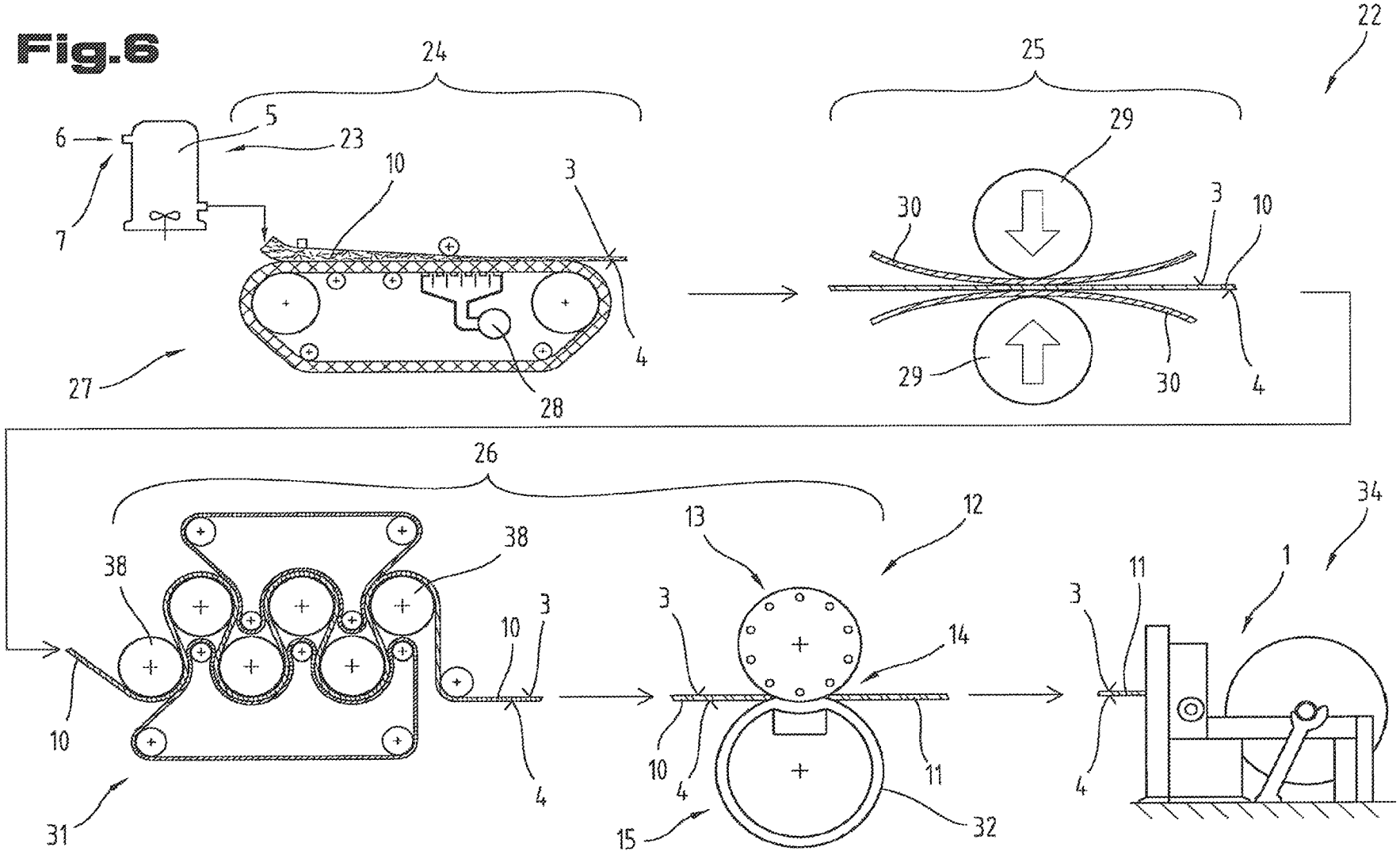
FIG. 6 shows an exemplary embodiment of a method scheme for producing a nonwoven web and drying it to form a paper web.
Figure 7:
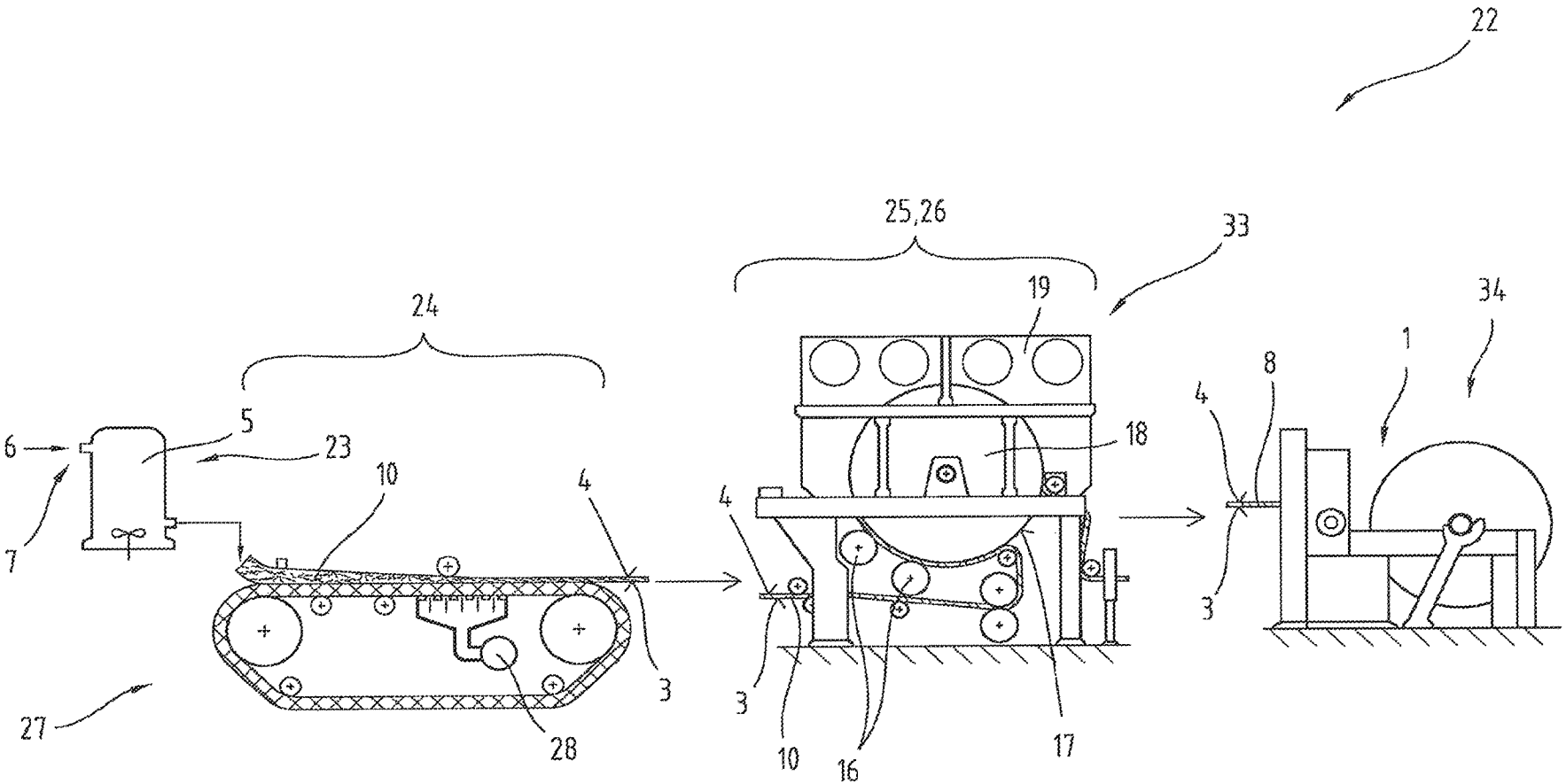
FIG. 7 shows a further exemplary embodiment of a process diagram for producing a nonwoven web and drying it to form a paper web.

FIGS. 6 and 7 each show exemplary embodiments of two process schemes or two paper machines 22, shown roughly schematically, for producing a nonwoven web 10 and drying it to form a paper web 11. The description of FIGS. 6 and 7 follows as far as is reasonable and possible in a combined view in order to avoid unnecessary repetitions, the same reference numbers being used for the same parts.

Regardless of how the pulp mixture is prepared to provide a pulp material 6, at least one aqueous suspension 5 comprising the pulp material 6 is produced for further processing of the pulp material 6. This process step is illustrated in FIGS. 6 and 7 by means of a tank 23 with an agitator. In particular, various usual additives 7 or additives and auxiliaries in paper technology such as fillers, starch, etc. can be added to this at least one aqueous suspension. At least one sizing agent can be added to the at least one suspension 5 as an additive 7, relative to the active substance of the sizing agent, in an amount of 0.05 wt. % to 2.0 wt. % relative to 100 wt. % total dry mass of at least one suspension 5. Sizing agents can be selected from a group consisting of alkenyl succinic anhydride (ASA), alkyl ketene dimer (AKD), resin sizes or natural sizing agents, or a mixture of sizing agents selected from this group.

Regardless of this, a consistency of the at least one aqueous suspension 5 can be set to a value of 0.15% to 0.5%, preferably from 0.18% to 0.4% before the homogenization and pre-drying to form at least one water-containing nonwoven web 10 having a first side 3 and a second side 4. Further processing of this at least one aqueous suspension 5 can then be carried out in a manner known per se by means of a paper machine 22. Usually, paper machines 22 can comprise a wire section 24, a press section 25 and a dryer section 26, each of these process steps comprising drying or dewatering processes According to the invention, it is provided that at least the first side 3 of the at least one nonwoven web 10 is compacted before, during or after one of the drying steps and before further processing to form a tray package unit outer packaging paper 1 with a linear load of 80 kN/m to 500 kN/m. This compaction step can either be produced in a single nip, i.e. in a single compaction step, or in several consecutively arranged nips, each with the indicated linear loads. The tray package unit outer packaging paper 1 is imparted a wet tensile strength index according to ISO 3781:2011 in the machine direction of at least 10 Nm/g.

In addition, it can be expedient if at least the first side 3 of the at least one nonwoven web 10 is thermally treated in the course of this compaction. In other words, this means that a thermal influence can take place in the same process step at the same time as the pressure is applied.

As shown in FIGS. 6 and 7, the at least one aqueous suspension 5 comprising the pulp material 6 can be applied to a circulating endless wire 27 of a wire section 24, as is known per se. In such a wire section 24, the at least one aqueous suspension 5 is homogenized and pre-dried to form at least one water-containing nonwoven web 10. The endless wire 27 can here be guided over dewatering means 28 of the wire section 24, which dewatering means 28 can be formed, for example, by suction strips. In principle, a dewatering in a wire section 24 can also take place merely by means of gravity. In addition, however, depending on the design of a wire section 24, for example, the dewatering or pre-drying of the at least one nonwoven web 10 is supported by generating a negative pressure. The first at least one first nonwoven web 10 comprising the pulp material 6 can be pre-dried by means of the wire section 24, for example, to a water content of 75 wt. % to 88 wt. %.

It can be the case that the first side 3 provided for compaction faces the endless wire 27, as is shown in FIG. 7. However, it can naturally also be expedient if the first side 3 intended for compaction faces away from the endless wire 27, as is shown in FIG. 6. The respective process management is dependent on the selected compaction concept.

The nonwoven web 10 can then be further dewatered or further dried by means of a press section 25. According to FIG. 6, the nonwoven web 10 can be passed between rollers 29 of the press section 25 and can thereby be further dewatered under pressure. In addition, further drying can be supported by means of absorbent support material 30. As is known per se, felt mats, for example, can be used for this purpose. A press section 25 according to FIG. 6 can, as is known per se, comprise more than just two rollers 29; in particular, a plurality of roller pairs formed by rollers 29 can be arranged one after the other. A water content of the nonwoven web 10 after it has been passed through a press section 25 can, for example, be about 40 wt. % to 65 wt. %, relative to the total mass of the nonwoven web 10.

According to FIG. 6, a so-called slalom dryer 31 can be arranged after the press section 25 as a drying section 26 or as part of a drying section 26. As shown in FIG. 6, a slalom dryer 31 can comprise numerous rotating slalom drying cylinders 38 over which the at least one nonwoven web 10 can be guided. The slalom drying cylinders 38 can be heated directly. For example, heating ducts, not shown in more detail, be designed to conduct hot steam into the slalom drying cylinder 38. Alternatively, it is also possible, for example, to heat the slalom drying cylinders 38 by means of electrical resistance heating. A temperature of the slalom drying cylinders 38 of a drying section 26 can, for example, increase successively in the direction of passage of the at least one nonwoven web 10. The nonwoven web 10 can be dried by means of the slalom dryer 31, for example to a water content of 1 wt. % to 10 wt. %

For compaction according to the invention with a line load of preferably 210 kN/m to 370 kN/m, a so-called wide nip calender 12 or shoe calender having a shoe length of, for example, 50 mm and a shoe tilt of 24% can be provided for further drying and compaction of the nonwoven web 10. For compaction according to the invention with a line load of preferably 380 kN/m to 490 kN/m, a shoe length of 75 mm and a shoe tilt of 24% can also be provided in a shoe calender, for example.

A wide nip calender 12 can substantially be formed by a heating roller 13 and by a shoe roller 15 cooperating with the heating roller 13. The shoe roller 15 can act as a flexible counter-pressure element for the heating roller 13 and can have a peripheral jacket 32. This circumferential jacket 32 interacts with the heating roller 13 and forms a wide nip 14. The first side 3 of the at least one nonwoven web 10 facing the heating roller 13 is satin-finished by being passed between the heating roller 13 and the shoe roller 15. This means that the nonwoven web 10 is simultaneously compacted with increased pressure and subjected to an increased temperature. Temperatures on the surface of the heating roller 13 can range from about 150° C. to 295° C. The temperature can be achieved, for example, by means of a thermal oil with a correspondingly higher oil flow temperature. Other heating elements such as an induction heating can also be provided to further stabilize the surface temperatures. In principle, it is also conceivable, but not shown in the figures, that a second, advantageously structurally identical, wide nip calender 12 is provided, which is arranged in the paper machine 22 in such a manner that a so-called satin finishing of the second side 4 is carried out in addition to the satin finishing of the first side 3 of the at least one nonwoven web 10. Depending on how the process is carried out, it can also be advantageous if the second wide nip calender 12 is mirrored, so that the shoe roller 15 is arranged above the heating roller 13.

It is also conceivable that after the wire section 24, a process-engineering combination of press section 25 and dryer section 26 is provided, by means of which the compaction according to the invention with a linear pressure of about 80 kN/m can be carried out in a first press, for example a shoe press, in a second press, for example, a smoothing press, at about 90 kN/m and in a third press, for example a smoothing press at about 100 kN/m. The surface temperature of the Yankee cylinder can be about 96° C., for example. This feasible embodiment is shown highly schematically in FIG. 7. As an alternative to the embodiment according to FIG. 6, FIG. 7 shows dewatering, compaction or pressurization by means of a drying cylinder 18, in particular by means of a so-called Yankee cylinder 33. Papers which are produced by means of such an arrangement or a comparable arrangement are usually referred to in the technical world as "machine-glazed" or "MG papers". As part of a paper machine 22, FIG. 7 thus shows a combined press section 25 and dryer section 26 in the form of a Yankee cylinder 33 with a dryer hood 19 or gas drying hood placed thereon. The at least one nonwoven web 10 adhering to a pick-up felt is pressed with its first side 3 by two pressure rollers 16 against the surface 17 of the steam-heated Yankee cylinder 33, wherein the at least one nonwoven web 10 is guided over a large part of the circumference of the drying cylinder 18 or the Yankee cylinder 33 and dried further or finish-dried by additional blowing of hot air by means of the drying hood 19.

The end of the paper machines 22 shown as an example in FIGS. 6 and 7 is represented by a winder 34, by means of which the finished at least one paper web 11 can be wound onto a roll. Alternatively, however, it is also conceivable and possibly also expedient if the at least one paper web 11 is fed directly to further processing or packaging. In principle, the paper web 11 can already be a ready-to-use tray package unit outer packaging paper 1. In most cases, however, the at least one paper web 11 is processed further to form a tray package unit outer packaging paper 1, for example, by being finished.

The machine concept actually selected or the actual process control can naturally deviate from the two schematic process sequences shown. Combinations of the process steps shown are also conceivable and possibly expedient. For example, the first side 3 can be compacted with a wide nip calender 12 and the second side 4 can be compacted with a Yankee cylinder 33, or vice versa. Naturally, two correspondingly arranged wide nip calenders 12 or two Yankee cylinders 33 can also be provided. In addition, process management using the reversed Yankee method is also conceivable.

Depending on how a paper machine 22 is constructed, the at least one suspension 5 can be produced with a consistency of 0.15% to 0.50%. Both high-consistency and low-consistency suspensions 5 can be used for arrangements based on FIG. 6 with a wide nip calender 12, whilst for an arrangement based on FIG. 7 with a Yankee cylinder 33, a low consistency suspension 5 having a consistency of 0.15% to 0.40% may be more appropriate.

However, it should be mentioned at this point that the properties of the resulting tray package unit outer packaging paper 1 can also be influenced by other production parameters with regard to the desired mechanical properties. For example, as already indicated, the mechanical properties can be influenced by the type of pulp itself, for example by selecting the type of wood(s) used to produce the pulp. Furthermore, the mechanical properties of the tray package unit outer packaging paper 1 can also be influenced by adding various additives 7 to the aqueous suspension 5. Examples of preferred additives have already been given above in this description.

The exemplary embodiments show possible design variants, where it should be noted at this point that the invention is not limited to the specifically illustrated design variants of the same, but rather that various combinations of the individual design variants with one another are also possible and this possibility of variation is based on the teaching on the technical action by the present invention in the ability of the person skilled in the art working in this technical field.

The scope of protection is determined by the claims. However, the description and drawings should be used to interpret the claims. Individual features or combinations of features from the various exemplary embodiments shown and described can represent independent inventive solutions. The object forming the basis of the independent inventive solutions can be found in the description.

All the information on value ranges in the present description is to be understood in such a way that it also includes any and all sub-ranges, e.g. the information 1 to 10 should be understood to mean that all sub-ranges are included, starting with the lower limit of 1 and the upper limit of 10, i.e. all sub-ranges begin with a lower limit of 1 or greater and end with an upper limit of 10 or less, e.g. 1 to 1.7, or 3.2 to 8.1, or 5.5 to 10.

Finally, for the sake of good order, it should be pointed out that some elements are shown not to scale and/or enlarged and/or reduced in size for a better understanding of the structure.

REFERENCE LIST

1 Tray package unit outer packaging paper
2 Tray package unit
3 First side
4 Second side
5 Suspension
6 Pulp material
7 Additive
8 Tray
9 Packaged goods
10 Nonwoven web
11 Paper web
12 Wide nip calender
13 Hot roller
14 Wide nip
15 Shoe roller
16 Pressure roller
17 Surface
18 Drying cylinder
19 Drying hood
20 Tray package unit outer packaging device
21 Turntable
22 Paper machine
23 Tank
24 Wire section
25 Press section
26 Drying section
27 Endless wire
28 dewatering agent
29 roller
30 support material
31 slalom dryer
32 jacket
33 Yankee cylinder
34 winder
35 end
36 overlapping area
37 opening
38 slalom drying cylinder

The invention claimed is:

1. A tray package unit outer packaging paper for packaging tray package units having a first side and a second side, which tray package unit outer packaging paper is made of at least one aqueous suspension comprising a pulp material and additives, wherein the pulp material comprises a pulp mixture of, long-fibre pulp having a length-weighted average fibre length according to ISO 16065-2:2014 of 1.5 mm to 3.0 mm or consists of such, that the suspension comprises at least one sizing agent as additive, which sizing agent is added in a quantity of 0.05 wt % to 2 wt % relative to 100 wt % of dry weight mass of the suspension in relation to the active substance of the sizing agent, that the at least one sizing agent is selected from the group of alkenyl succinic acid anhydride (ASA), alkyl ketene dimer (AKD), resin sizes or natural sixing agents or comprises a mixture of sizing agents selected from this group at least the first side is compacted with a linear load of 80 kN/m to 500 kN/m and that the tray package unit outer packaging paper has a wet strength index according to ISO 3781:2011 in the machine direction of at least 10 Nm/g.

2. The tray package unit outer packaging paper according to claim 1, wherein the tray package unit outer packaging paper has a maximum extensibility in accordance with ISO 1924-3:2005 of 2.0% in the machine direction and of 2.5% in the cross direction.

3. The tray package unit outer packaging paper according to claim 1, wherein the first side is thermally treated in the course of compaction, preferably at a temperature of 90° C. to 97° C. and/or at a temperature of 150° C. to 295° C.

4. The tray package unit outer packaging paper according to claim 1, wherein the pulp mixture comprises 10 wt. % to 90 wt. % long-fibre pulp, in particular 50 wt. % to 90 wt. % long-fibre pulp and 10 wt. % to 90 wt. % short-fibre pulp.

5. The tray package unit outer packaging paper according to claim 1, wherein the suspension is produced with a consistency of 0.15% to 0.50%.

6. The tray package unit outer packaging paper according to claim 1, wherein the compacted first side has a Cobb 1800s value in accordance with ISO 535:2014 of 35 $g/m^2$ to 70 $g/m^2$.

7. The tray package unit outer packaging paper according to claim 1, wherein a difference of a Cobb 1800s value according to ISO 535:2014 between the compacted first side and the non-compacted or less strongly compacted second side is a maximum of 3 $g/m^2$.

8. The tray package unit outer packaging paper according to claim 1, wherein the compacted first side (3) has a Bendtsen roughness in accordance with ISO 8791-2:2013 of 100 ml/min to 450 ml/min.

9. The tray package unit outer packaging paper according to claim 1, wherein the tray package unit outer packaging paper has a gloss value in accordance with TAPPI T 480: 2015 of 21% to 33%.

10. The tray package unit outer packaging paper according to claim 1, wherein the tray package unit outer packaging paper has a bending resistance index in accordance with ISO 2493-1:2010 using a bending angle of 15° and a test bending length of 10 mm of 210 $Nm^6/kg^3$ to 330 $Nm^6/kg^3$ in the machine direction and 110 $Nm^6/kg^3$ to 160 $Nm^6/kg^3$ in the cross direction.

11. The tray package unit outer packaging paper according to claim 1, wherein a ratio of a tearing resistance in accordance with ISO 1974:2012 in the machine direction to the tearing resistance in accordance with ISO 1974:2012 in the cross direction is 0.6 to 1.1.

12. The tray package unit outer packaging paper according to claim 1, wherein at least the compacted first side can be printed with colour densities of at least 1.0.

13. The method for producing a tray package unit outer packaging paper, according to claim 1 for the packaging of tray package units, comprising the steps:

providing a pulp material, producing at least one aqueous suspension comprising the pulp material and optionally adding additives to the suspension, homogenizing the at least one aqueous suspension and pre-drying to form at least one water-containing nonwoven web having a first side and a second side, drying the at least one water-containing nonwoven web in one or more drying steps to form at least one papier web with a first side and a second side, further processing the at least one paper web to form a tray package unit outer packaging paper, wherein before, during or after one of the drying steps and before the further processing to form a tray package unit outer packaging paper at least the first side of the at least one nonwoven web is compacted with a linear load of 80 kN/m to 500 kN/m and that the tray package unit outer packaging paper has a wet tensile strength index in accordance with ISO 3781:2011 of at least 10 Nm/g in the machine direction.

14. The method according to claim 13, wherein at least one nonwoven web is compacted by means of a wide-nip calendar comprising a heated roller and a shoe roller cooperating with the heated roller and forming a wide nip, wherein the at least one nonwoven web is guided through the wide-nip calendar with its first side facing the heated roller.

15. The method according to claim 13, wherein at least one nonwoven web is pressed by means of one or more pressure rollers with its first side onto the surface of a heated drying cylinder, in particular a Yankee cylinder, wherein the at least one nonwoven web is guided over a large part of the circumference of the drying cylinder and is additionally heated from outside by means of a drying hood at least partially surrounding the drying cylinder.

16. Use of an outer packaging material for the outer packaging of a tray package unit, the tray package unit comprising a tray, a shell, a punnet or a tray, which tray is equipped with packaged goods, wherein a tray package unit outer packaging paper according to claim 9 is used as outer packaging material.

* * * * *